US007387262B2

(12) United States Patent
Thoma

(10) Patent No.: US 7,387,262 B2
(45) Date of Patent: Jun. 17, 2008

(54) HEAT GENERATOR

(76) Inventor: Christian Thoma, The Court House, La grande Route Des Sablons, Fauvic, Grouville, Jersey (GB) JE3 9FG ( * ) Notice: Subject to any disclaimer, the term of this patent is extended or adjusted under 35 U.S.C. 154(b) by 518 days.

(21) Appl. No.: 10/855,629

(22) Filed: May 28, 2004

(65) Prior Publication Data

US 2005/0263607 A1 Dec. 1, 2005

(51) Int. Cl.
*B60H 1/02* (2006.01)

(52) U.S. Cl. ..... 237/12.3 R; 123/142.5 R; 237/12.3 B

(58) Field of Classification Search ..... 237/12.3 R, 237/12.3 B; 165/41, 42; 123/142.5 R
See application file for complete search history.

(56) References Cited

U.S. PATENT DOCUMENTS 3,198,191 A 8/1965 Wyszomirski
3,720,372 A 3/1973 Jacobs
3,731,729 A * 5/1973 Beatenbough et al. ..... 165/204
3,791,349 A 2/1974 Schaefer
4,106,472 A * 8/1978 Rusk ..... 123/205
4,277,020 A 7/1981 Grenier
4,312,322 A 1/1982 Freihage
4,424,797 A 1/1984 Perkins
4,493,293 A * 1/1985 Paul et al. ..... 123/41.12
4,974,778 A * 12/1990 Bertling ..... 237/12.3 B
5,141,328 A 8/1992 Dilley
5,188,090 A 2/1993 Griggs
5,341,768 A 8/1994 Pope
5,683,031 A * 11/1997 Sanger ..... 237/1 R
5,743,467 A * 4/1998 Ban et al. ..... 237/12.3 R
5,819,724 A 10/1998 Hybertson
5,829,676 A * 11/1998 Ban et al. ..... 237/12.3 R
5,842,635 A * 12/1998 Okabe et al. ..... 237/12.3 R
5,842,636 A * 12/1998 Moroi et al. ..... 237/12.3 R
5,871,149 A * 2/1999 Moroi et al. ..... 237/12.3 R
5,913,306 A 6/1999 Moroi et al.
5,915,341 A 6/1999 Moroi et al.
5,931,153 A 8/1999 Giebeler et al.
5,947,376 A * 9/1999 Moroi et al. ..... 237/12.3 R
5,957,121 A * 9/1999 Suzuki et al. ..... 126/247
5,979,163 A * 11/1999 Hanners et al. ..... 60/571
6,039,007 A * 3/2000 Ban et al. ..... 122/26
6,082,316 A * 7/2000 Ban et al. ..... 123/142.5 R
6,129,287 A 10/2000 Hirose et al.
6,152,084 A 11/2000 Ban et al.

(Continued)

FOREIGN PATENT DOCUMENTS

JP 60-226594 11/1985

(Continued)

*Primary Examiner*—Derek S. Boles
(74) *Attorney, Agent, or Firm*—Young & Thompson

(57) ABSTRACT

An apparatus for the heating of a viscous fluid contained in a heat generating chamber by a rotatable unit having a fluid shearing surface formed on a face thereof, the unit by shearing of the viscous fluid on that face induces the heating of said viscous fluid and where an external heat extracting surface is provided for this heat to be removed by a further fluid in contact with that surface. The two dissimilar fluids are kept apart by at least the housing acting as a fluid partition. The unit has an interior space as a storage location for viscous fluid with a deformable element for volume changes of the viscous fluid during the operation of the apparatus.

3 Claims, 10 Drawing Sheets

U.S. PATENT DOCUMENTS 6,158,665 A * 12/2000 Moroi et al. ..... 237/12.3 R
6,244,232 B1 * 6/2001 Ban et al. ..... 123/124.5 R
6,308,896 B1 * 10/2001 Moroi et al. ..... 237/12.3 R
6,325,298 B1 * 12/2001 Hielm ..... 237/12.3 R
6,386,751 B1 5/2002 Wootan et al.
6,489,598 B1 * 12/2002 Hielm ..... 219/631
6,823,820 B2 * 11/2004 Thoma ..... 122/26
6,900,561 B2 * 5/2005 Vlemmings et al. ..... 310/59
6,910,448 B2 * 6/2005 Thoma ..... 122/26
6,959,669 B2 * 11/2005 Thoma ..... 122/26
6,976,486 B2 * 12/2005 Thoma ..... 126/247
7,089,886 B2 * 8/2006 Thoma ..... 122/26

FOREIGN PATENT DOCUMENTS

JP 62-213895 9/1987
WO 99/11478 3/1999

* cited by examiner

HEAT GENERATOR

BACKGROUND OF THE INVENTION

This invention relates to a heat generator, typically employed in automobiles, the generator having an operating chamber defined in a housing, a rotor disposed inside the housing and driven by a shaft which is connected to some form of driving machine like the vehicle engine or an electric motor. The operating chamber contains a viscous fluid and where heat generated by the rotor rotating in the viscous fluid can be extracted from the generator by passing another fluid across the surface of the housing, typically by means of an annular passageway formed between the housing and a surrounding housing jacket through which heat extracting fluid flows. Therefore the operating chamber of the generator is the heat generating chamber containing the viscous fluid whereas the annular passageway is the heat radiating chamber through which the heat exchanging fluid such as engine coolant is arranged to pass through, and which, for instance, can be piped to the passenger compartment of an automobile.

Furthermore, generators may also be applied to interface directly with the surrounding fluid contained in a reservoir. In this case, no jacket is required as the housing is at least partially submerged in the reservoir fluid, and heat is directly conducted from the housing by the surrounding fluid in the reservoir.

Of the many types of heat generators known, a typical example is shown in U.S. Pat. No. 6,129,287. Here a rotor element is formed to include a tubular portion which serves as a storage chamber for the viscous fluid and where an solenoid-operated actuator mounted on the generator used to regulate the amount of viscous fluid arriving or departing the storage chamber. Hydraulic systems with flow control devices operating without fluid filtration have been know to be troubled by fluid borne contamination, especially when surfaces become scoured should abrasive material reach in-between the sliding surfaces, causing leakage. By contract, U.S. Pat. No. 6,152,084 discloses an alternative form of heat generator where no provision is made for regulating the amount of viscous fluid held by the heat generating chamber, as here the chamber remains at 50% to 70% full of fluid. The chamber is largely occupied by a rotor having the form of a flat disc positioned between respective faces of a surrounding housing. During operation, as the viscous fluid held by the heat generating chamber heats up, the expanding volume of viscous fluid takes up an increasing portion of the initial 30% to 50% dead space volume. As a consequence, some interior space is wasted due to there being provision for an air or inert gas pocket and as a result, and performance during operation may be lower than with the earlier type described in U.S. Pat. No. 6,152,084 due to the mixing of the gas with the viscous fluid during operation.

There is a need for a new solution for an improved heat generator whereby the working pressures existing within the heat generating chamber can be used with good effect to allow in the adjustment of the volume amount of viscous held in fluid heat generating chamber, depending on operating conditions. The chances of external leaking of fluid into the environment due to expanding volume of fluid should be avoided whenever possible The present invention seeks to alleviate or overcome some or all of the above mentioned disadvantages of earlier machines, in a device that is simple to build, comprising few working parts and having preferably cavitational as well as fluid shearing characteristics for generating heat in the viscous liquid.

SUMMARY OF THE INVENTION

It is therefore an object of the present invention to provide a new and improved heat generator that addresses the above needs. It is a still further object of the invention to provide a method for doing so.

According to a preferred embodiment of the invention, the heat generator is able to take care of any change in volume of viscous fluid due to changing temperature conditions without relying, either on having a large dead volume space occupied by inert gas or air, or an electrically operated actuator for controlling the amount of fluid carried by the housing.

Preferably, the heat generator operates to produce heat through the shearing of the viscous fluid between the static and moving fluid boundary surfaces provided by the housing and rotor respectively, as well as by additional heat produced through negative pressures and cavitation occurring in certain internal regions of the device. However, the invention may equally be apply to devices relying only in the shearing of the viscous fluid to produce heat.

Although the heat generator may comprise its own viscous fluid storage location in the interior of the rotor/drive shaft, it is a preferred feature of the invention to include an internal volume expanding and contracting element mounted to the housing and protruding towards the interior of the rotor/drive shaft to take up any volume changes of the viscous fluid during the operational cycle.

It is a further preferred feature of the present invention that the rotational energy imparted to the viscous fluid by the rotating rotor/drive shaft causes a radially outwardly displacement of the viscous fluid from the interior of the rotor/drive shaft. Any air or inert gas that might be present in the heat generating region during operation is more likely to remain nearer the interior of the rotor/drive shaft and away from the rotor exterior surface where it might lessen the performance of the device.

Various rotor shapes are disclosed in this specification and as preferred, all rotors are shown either with surface irregularities in the form of parallel bottom-ended holes disposed along the surface of the rotor, or holes arranged to short-circuit with the interior of the rotor/drive shaft to ensure such holes may be adequately supplied with fluid for the shearing to be effective over the face of the rotor. When used, such bottom-ended holes create low pressure zones in and about the viscous fluid, the fluids being squeezed and expanded by the vacuum pressure and the condition of cavitation together with accompanying shock wave behavior producing sufficient turbulence to ensure a more even distribution in viscous fluid in contact any one time with the rotor peripheral surface.

For certain applications, there may be an advantage if any entrained air carried by the viscous fluid can be removed prior to the viscous fluid being poured into the heat generating chamber. By incorporating such an expanding and contracting element into the heat generating chamber, the entire volumetric space of the heat generating chamber may as a result be usefully employed to carry a full capacity of viscous fluid without the need to fit either a fluid level regulating valve or air pocket space to cope with fluid volume expansion due to a rise in fluid temperature. Equally, the lack of air or inert entrained in the viscous fluid is likely to result in a more positive performance.

In one form thereof, the invention is embodied as an apparatus for the heating of two dissimilar fluids comprising a housing having an internal heat generating chamber and an external heat extracting surface. One of two dissimilar fluids is a viscous fluid disposed in the heat generating chamber, the other of the two dissimilar fluids is the heat extracting fluid for direct contact with the heat extracting surface. A rotatable unit is disposed centrally in the heat generating chamber and mounted for rotation within the heat generating chamber about an axis of rotation and where a deformable element is in fluid communication with said heat generating chamber.

Other and further important objects and advantages will become apparent from the disclosures set out in the following specification and accompanying drawings.

BRIEF DESCRIPTION OF THE DRAWINGS

The above mentioned and other novel features and objects of the invention, and the manner of attaining them, may be performed in various ways and will now be described by way of examples with reference to the accompanying drawings, in which.

These figures and the following detailed description disclose specific embodiments of the invention; however, it is to be understood that the inventive concept is not limited thereto since it may be incorporated in other forms.

DETAILED DESCRIPTION OF THE FIRST ILLUSTRATIVE EMBODIMENT OF THE INVENTION

Figure 1:
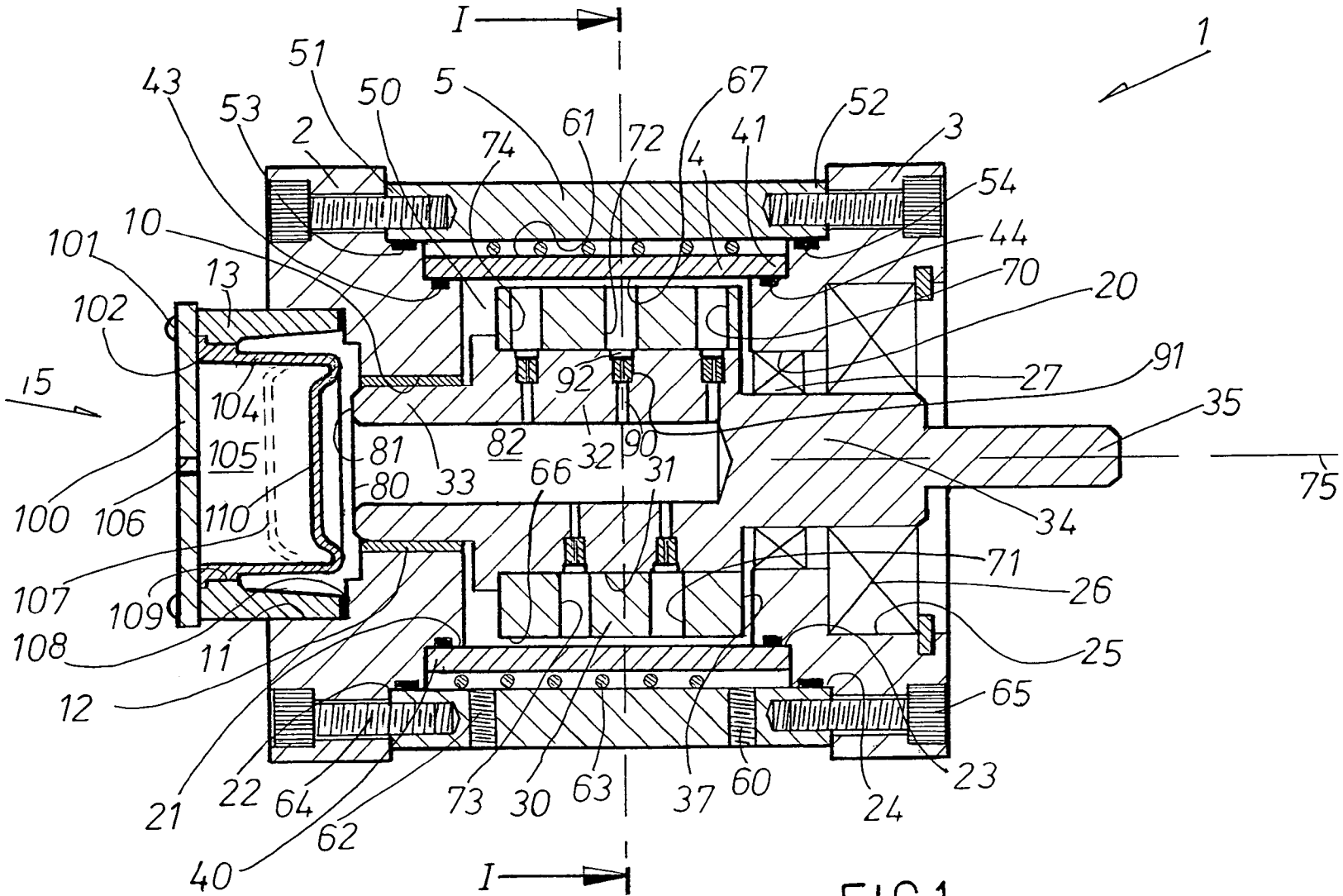
FIG. 1 is a longitudinal sectional view of a device in according to the first embodiment of the present invention.
Figure 4:
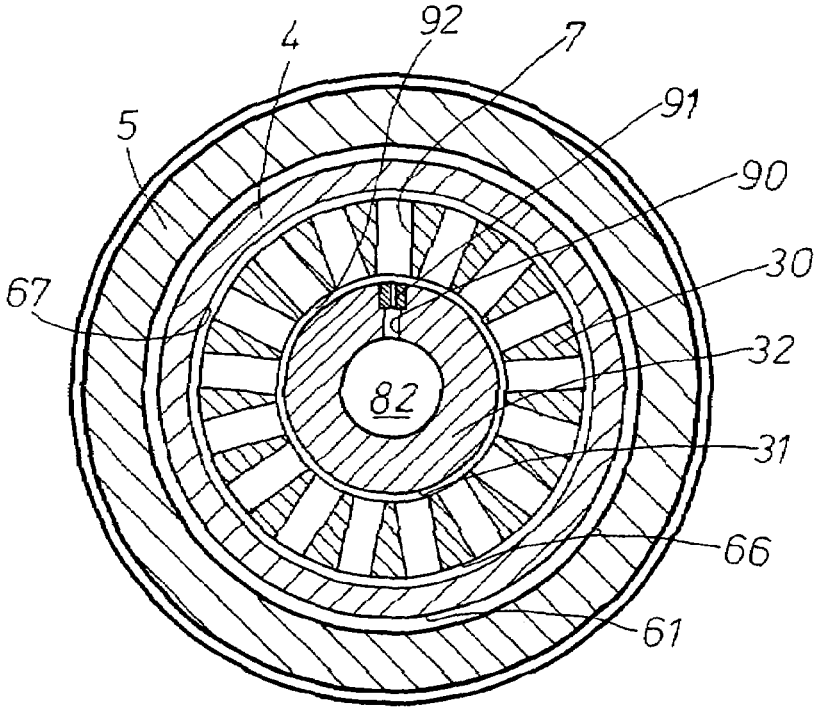
FIG. 4 is a transverse sectional view of the device taken along line I-I in FIG. 1 showing a further alternative form of rotor interior.

Referring to FIGS. 1 and 4, the device denoted by reference numeral 1 shows an entire housing structure comprising four members, a rear housing member 2, a front housing member 3, a sleeve member 4 surrounded by an outer jacket member 5. Rear housing member 2 is provided with a stepped central bore shown as 10, 11, and where a bearing 12 is disposed in the smaller sized bore 10 and part of the housing portion 13 of the deformable element indicated by reference numeral 15 is threaded into bore 11. A pair of registration shoulders 21, 22 are located on rear housing element 2 and a complementary pair of registration shoulders 23, 24 is provided on front housing element 3. Front housing element 3 is provided with a stepped central bore shown as 20, 25, and where a bearing 26 is disposed in bore 25 and a seal 27 in bore 20. The rotatable unit for this embodiment is shown comprising a rotor portion 30 seated, preferably as a heat shrink fit, on the diameter 31 of the central drive shaft portion 32, the inner shaft portion 33 supported by bearing 12, and towards the outer end portion 34 by bearing 26. The rotatable unit extends from housing member 3 and is shown as the protruding shaft portion 35, portion 35 being drivingly engaged to a suitable prime mover. Fluid seal 27 in bore 20 operates against rotating shaft portion 34 and may typically be a rotary lip seal or double lip seal capable to working under positive as well as negative pressure conditions, although it should be noted all embodiments may easily be adapted to incorporate other types of seals that are readily available. For instance, a spring-loaded face seal could be used operating against end face 37 of the rotatable unit. However, if the transmission of power to the device is without any direct mechanical connection such as the example here depicted of an externally protruding drive shaft portion 25, there would no longer be any need to fit a seal.

Bearing 12, residing at inner shaft portion 33, is lubricated by viscous fluid inside the heat generating chamber. However, should it be advantageous for another type of fluid or lubricant to be used solely for the lubrication of this bearing 12, housing member 2 may easily be modified to include the addition of seal receding at both ends of bearing 12. Bearing 12, although shown here as a journal bearing, could in practice be a roller or ball bearing.

Sleeve member 4 surrounds rotor portion 30 and where one end 40 engages registration shoulder 21 whereas the opposite end 41 engages registration shoulder 23. Static seals 43, 44 are disposed as these respective interfaces and as a result, the resulting interior space denoted by reference numeral 50 is the heat generated chamber where the viscous fluid resides. In a similar fashion, outer jacket member 5 surrounding sleeve member 30, and where one end 51 engages registration shoulder 22 and the opposite end 52 registration shoulder 24. Static seals 53, 54 are disposed as these respective interfaces and as a result, the resulting annular interior space or pathway between sleeve 4 and jacket 5 is where the heat extracting fluid flows, entering through port 60 and departing, once it has extracted heat from the exterior surface 61 of sleeve 4, from port 62. Exterior surface 61 is termed the external heat extracting surface (in this embodiment, surrounded by jacket 5). A simple device such as a coiled spring 63 disposed between sleeve 4 and jacket 5 may be used to impart a beneficial flow pattern to the fluid passing between port 60 and port 62.

A plurality of screws 64, 65 are used to fixed jacket 5 rigidly to respective housing members 2, 3, and where sleeve member 4 can be said to be sandwiched between these three other housing members.

The exterior surface 66 of the rotor portion 30, being the face of the rotor ostensibly providing the fluid shearing surface, provides a first fluid boundary defining surface whereas bore 67 of sleeve member 4 provides a second fluid boundary defining surface, this boundary surface remaining static at all times. The viscous fluid being the heat generating fluid of the device, operates between the fluid boundary surfaces to produce heat of the fluid through fluid shearing. In addition to this heat generating shearing of the heat generating fluid, preferably over the exterior surface 66 of rotor portion 30, there are provided a plurality of rows, five in this example, of radial holes 70, 71, 72, 73, 74, each opening on said first fluid boundary surface. Such holes may be angled with respect to the longitudinal axis denoted by reference number 75 of the rotatable unit, but preferably as shown, are arranged such their longitudinal axes are perpendicular to axis 75. The interior of the rotatable unit is partially hollow as shown, termed the interior vessel of the rotor for storage of viscous fluid, and where an entrance port 80 is provided in the end face 81 of shaft portion 33, the entrance port 80 opening to a longitudinal passageway 82. As shown, each row of holes 70, 71, 72, 73, 74 is connected by a respective passage and throttle holes, termed the fluid throttling orifice, best seen in FIGS. 1 & 2 as passage 90 and throttle hole 91 which are for row of holes 72, so that viscous fluid in longitudinal passageway 82 can flow and reach the first fluid boundary surface on the rotor exterior 66. The purpose of including such fluid throttling orifices is generally two fold. Firstly, to slow down the flow rate by producing a resistance to the flow of fluid from, for example, longitudinal passageway 82 to the third row of holes 72. Secondly, where applicable, to create a negative pressure condition near to the top of the hole when the storage vessel is partially evacuated and without starving the fluid shearing surface of fluid.

Figure 2:
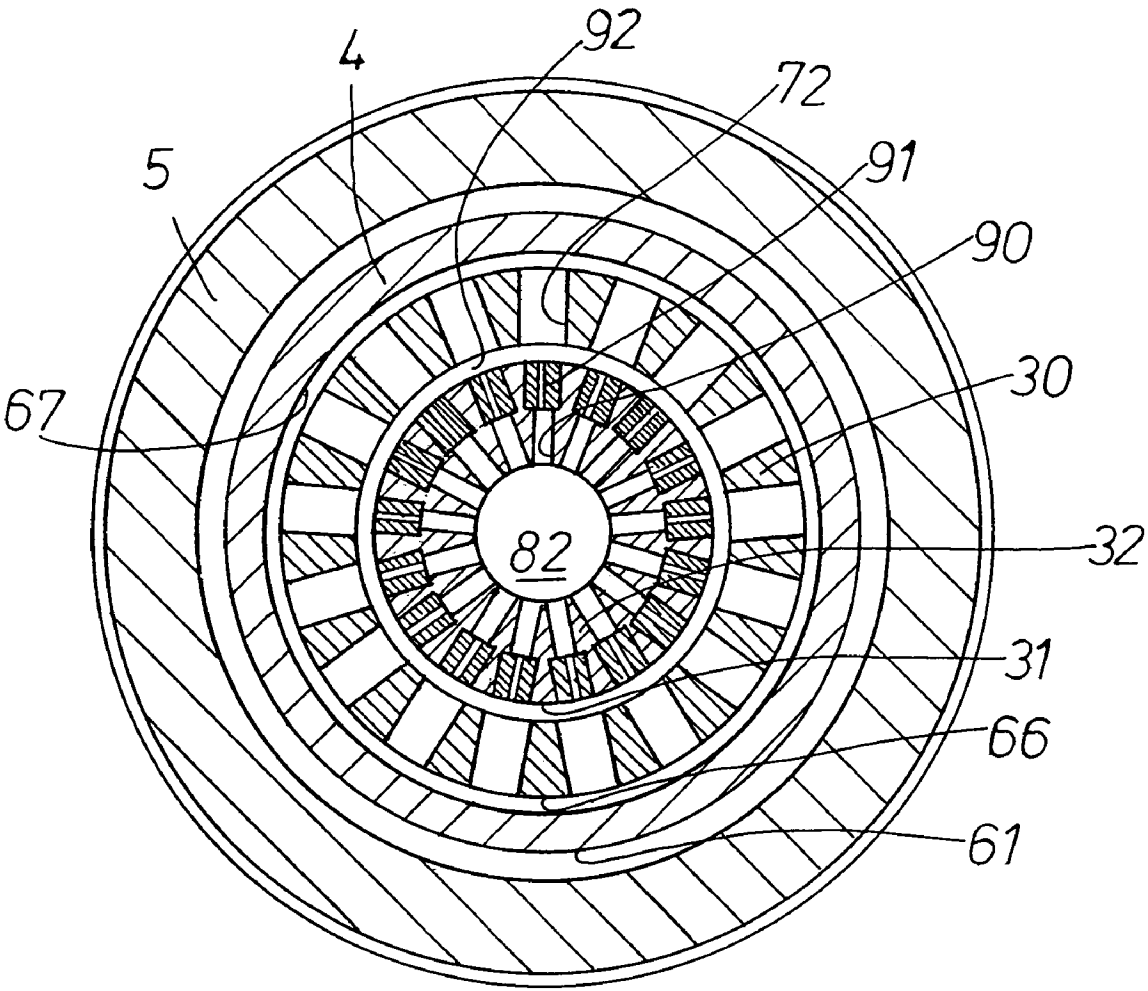
FIG. 2 is a transverse sectional view of the device taken along line I-I in FIG. 1.
Figure 3:
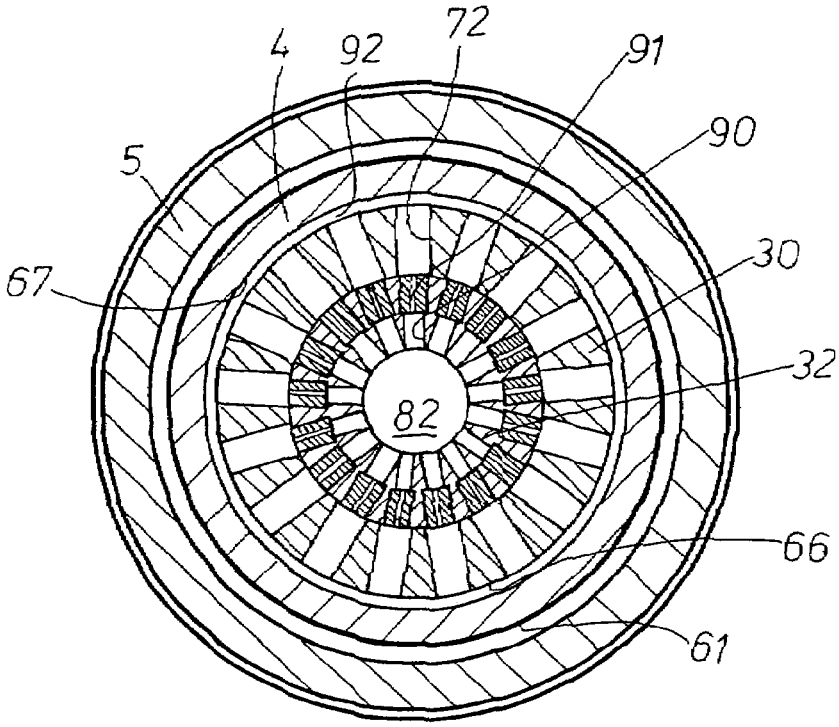
FIG. 3 is a transverse sectional view of the device taken along line I-I in FIG. 1 showing an alternative form of rotor interior.

As shown in FIG. 2, there are eighteen such individual drilled holes 72 that make up this particular row and eighteen throttles 91, and where a circumferential groove 92 is located on middle portion 32. The purpose of groove 92 is to ensure, should any of the throttles 91 become blocked by contamination, its corresponding hole can still receive viscous fluid from adjacent throttles fluidly linked to it by the groove. If such contamination is of a lesser concern, the groove may be omitted as shown in FIG. 3. Here each throttle 91 is the only fluid link between each respective pairs of hole 72, 90.

However, FIG. 4 shows a further modification, and where only a single passage 90 is provided, passage 90 fluidly connecting via a single throttle 91 to circumferential groove 92. Viscous fluid thus arriving circumferential groove 92 from longitudinal passageway 82, with this example is distributed to all eighteen radial holes 72.

As already briefly mentioned, device 1 is fitted with a deformable element generally referenced by numeral 15, and apart from its housing portion 13 which is attached to bore 11 of housing member 2, it also has a cover plate 100 screwed or otherwise riveted, visible in FIG. 1 as rivet heads 101, to housing portion 13. Inside resides a deformable element such as a diaphragm 104 manufactured in a pliable material such as neoprene. The diaphragm 104 is cup like in shape with an open end 102 adjacent plate 100 and a closed end 110, here shown, relatively closely positioned to end face 81 of shaft portion 33. This position is likely when the device 1 is at rest and the volume of viscous fluid in the heat generating chamber is at a minimum volume. The pocket inside, denoted by reference numeral 105, is preferably full of ambient air at atmospheric pressure, and where a breather hole 106 in plate 100 allows the diaphragm 104 when towards plate 100, to expel air from pocket 105 through hole 106. Such movement of the diaphragm 104 will occur for instance, when the viscous fluid inside the device 1 warms up and expands, the expansion of the fluid pressing against closed end 110 of diaphragm 104 to cause it to deform and move in a general direction towards plate 100, as shown by the position of dotted lines 107. A static seal 108 between housing portion 13 and housing member 2 ensures there is no external leakage of viscous fluid to the environment, and equally, the exterior side wall 109 of diaphragm 104 provides a seal against the interior surface of housing portion 13.

To produce heat from the device 1, rotation of the rotatable unit inside sleeve 4 causes fluid shearing of the viscous fluid between the fluid defining boundaries, the static bore 67 of sleeve 4 on the one hand, and the rotating exterior fluid shearing surface 66 of the rotor portion 30, on the other hand. This imparted heat-generating friction causes the volume of viscous fluid to increase, causing diaphragm 104 to move from the position shown to that indicated by the dotted line 107. When used, a rotor portion 30 provided with holes 73, may provide additional heating of the viscous fluid by imparting heat-generating cavitation. Heat extracting fluid, for example coolant fluid of an automobile engine, piped to inlet port 60 and arriving into the pathway picks up heat from the external heat extracting surface 61 of sleeve member 4, and takes heat from the device 1 leaving the pathway at exit port 62 for wider distribution to the passenger compartment of the automobile where it is desirous that heating of that space takes place.

DETAILED DESCRIPTION OF THE SECOND ILLUSTRATIVE EMBODIMENT OF THE INVENTION

Figure 5:
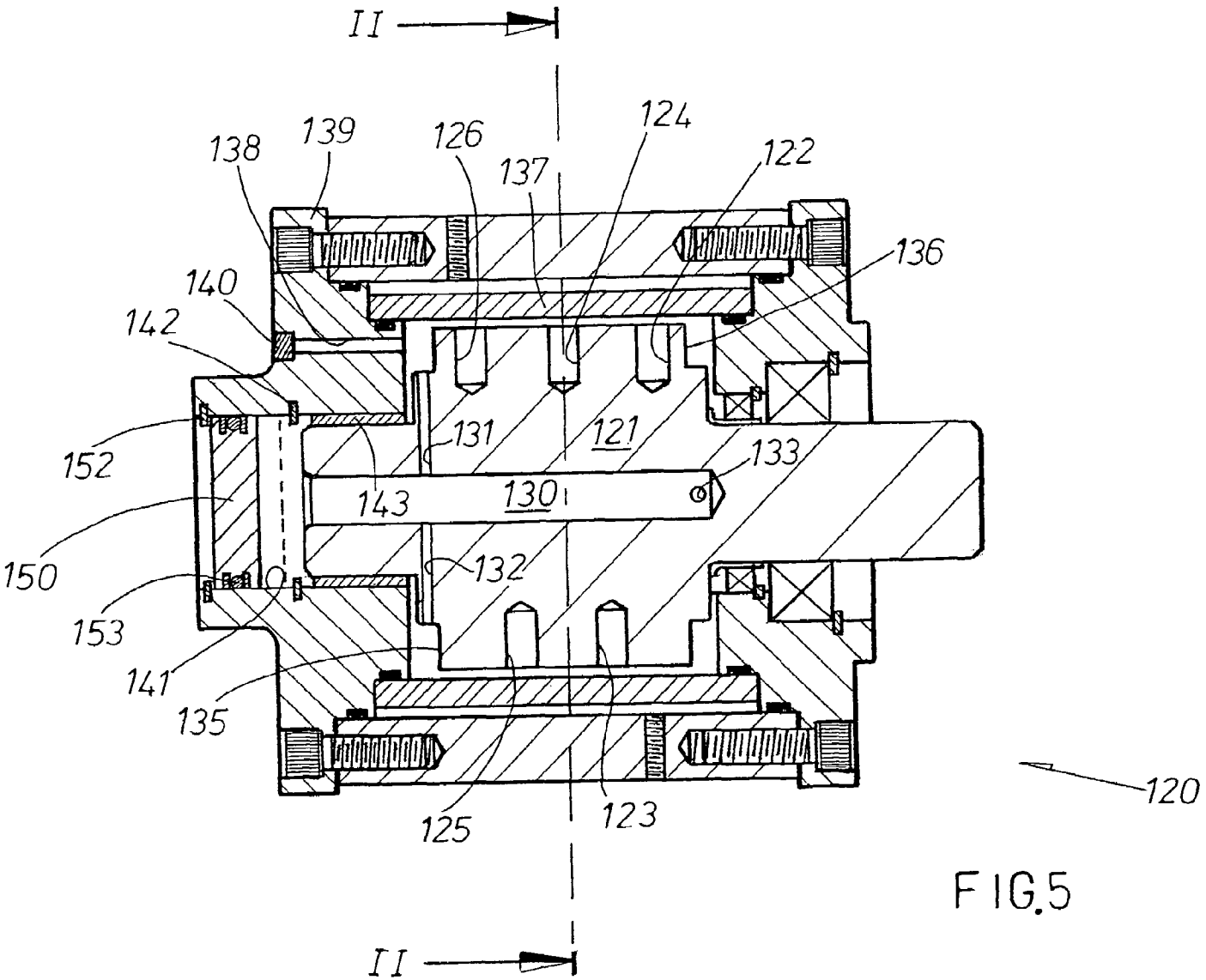
FIG. 5 is a longitudinal sectional view of a device in according to the second embodiment of the present invention.
Figure 6:
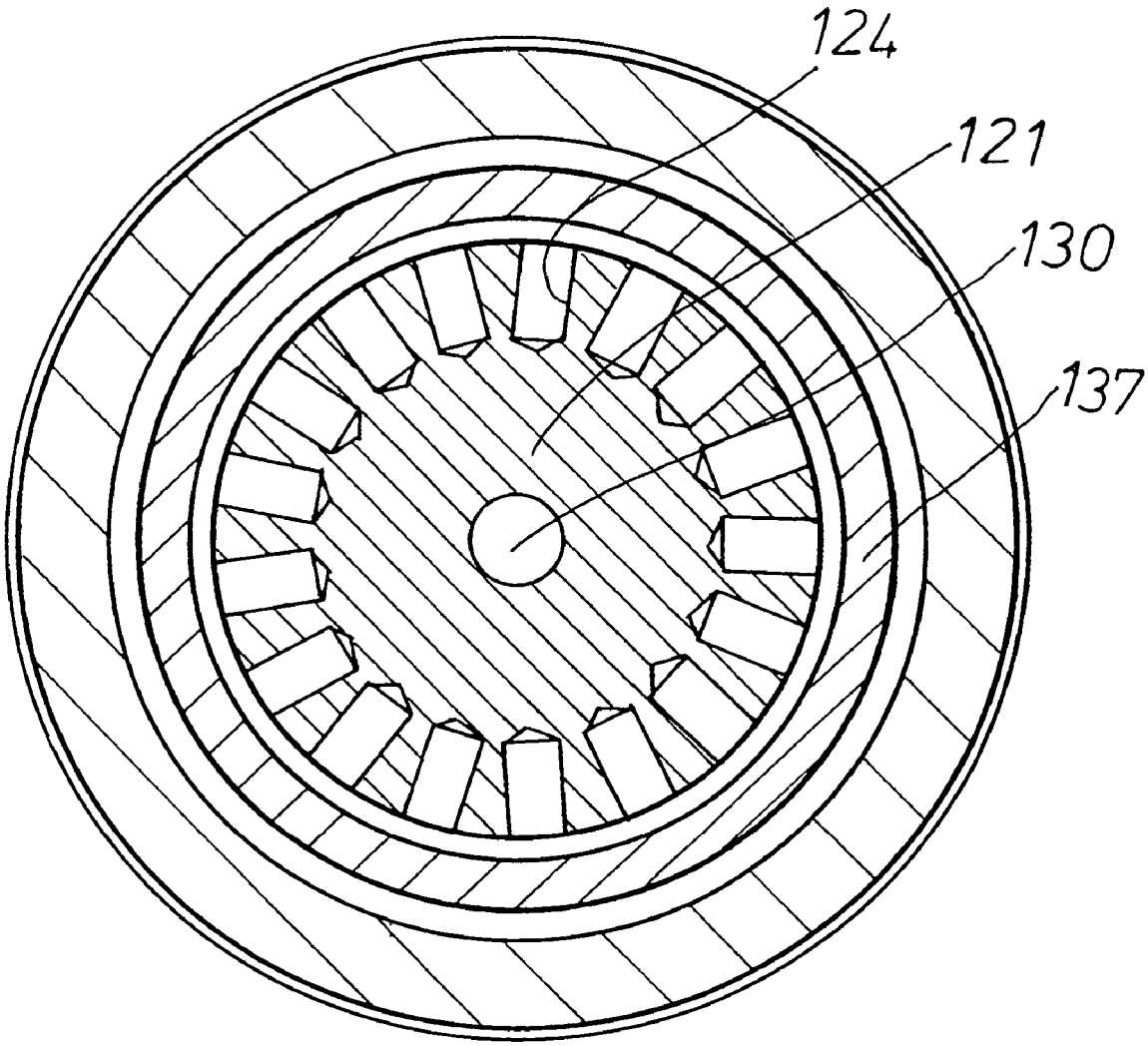
FIG. 6 is a transverse sectional view of the device taken along line II-II in FIG. 5.

For FIGS. 5 & 6, the device denoted by reference numeral 120, has a single unitary rotor/shaft component 121 and where component 121 is provided with five rows of bottom-ended holes denoted as each respective row by reference numerals 122, 123, 124, 125, 126. Note that unlike the first embodiment, none of these bottom-ended holes are in direct communication with longitudinal passageway 130. Here a number of radial passages 131, 132 as well as 133 are disposed in component 121, and where they communicate longitudinal passageway 130 with the space of the heat generating chamber adjacent respective faces shown as 135, 136 and surrounded by sleeve member 137. Passage 138 in end housing member 139 is provided for filling the heat generating chamber with viscous fluid, and plug 140 shuts off the passage 138. Rear housing member 139 is provided with a central bore 141, interrupted at approximately mid length by circlip 142. To one side of circlip 142 is a bearing 143 for partial support of component 121, and to the other side resides piston member 150. Piston member 150, unlike the diaphragm 104 of the first embodiment, is not deformable be can move by sliding axially in bore 141. Preferably, it is slightly magnetic to attract any fluid borne ferrous material residing in the viscous fluid. As the viscous fluid in the heat generating chamber expands with rising temperature, piston member 150 moves in bore 141 towards an end stop, here provided by circlip 152. A seal shown as 153 positioned between bore 141 and piston member 150 prevents the occurrence of any material leakage at this interface. However, in the event of a small amount of leakage, which after many of hours of operation, for lubrication of bore 141, might result in a slight lowering of the level of viscous fluid contained in the heat generating chamber, plug 140 can be removed so that an additional quantity of replacement fluid purposes can be easily added.

Concerning piston member 150, during operation as the volume of viscous fluid in the heat generating region expands with rising temperature, the piston member 150 is cause by internal pressure to move in a direction towards outermost circlip 152. As the fluid cools, ambient atmospheric pressure acting on the piston member 150 moves it in a direction towards innermost circlip 142. Although not shown, a simple biasing means such as a spring, disposed between outermost circlip 152 and the piston member, could be used to ensure that the piston member resides in its correct position once the device has cooled down after use.

Concerning heat generation during operation, that amount of viscous fluid that initially might be residing in bottom-ended holes 122, 123, 124, 125, 126, on commencement of rotation of rotatable unit 121, that fluid is entirely or partially expelled by centrifugal force from these bottom-ended holes, and the resulting vacuum condition in and around the openings of the holes on the fluid shearing surface cause an additional heating of the viscous fluid by hydrodynamic cavitation of the fluid. The heat once created, is then removed from the generator in a similar fashion as has already been described for the first embodiment. Depending on the initial level of viscous fluid held by the heat generating chamber, once operating at operational temperature, longitudinal passages 130 may well be partially or fully evacuated of viscous fluid.

DETAILED DESCRIPTION OF THE THIRD ILLUSTRATIVE EMBODIMENT OF THE INVENTION

Figure 7:
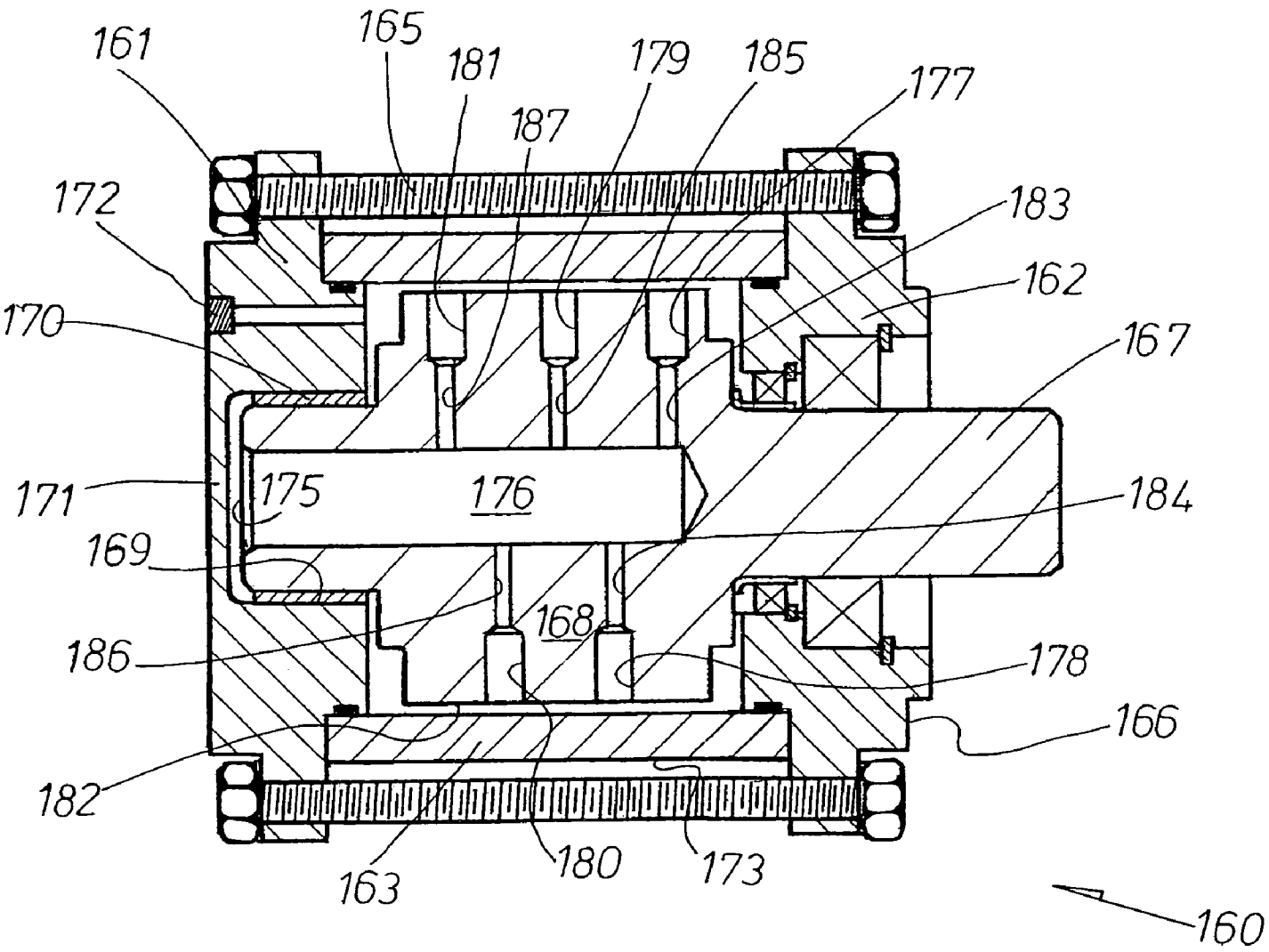
FIG. 7 is a longitudinal sectional view of a device in according to the third embodiment of the present invention.

As the device 160 in FIG. 7 differs in only two major respects to the earlier two embodiments, description is therefore only necessary to show the main points of difference. Firstly, as no jacket is shown, the complete housing structure comprises three housing members, these being the rear 161 and front 162 housing members and the in-between sandwiched sleeve member 163. A number of studs 165 are used to hold the members together. The reason why this embodiment does not have an outer jacket for the heat extracting fluid is due to this type residing largely or entirely immersed in a fluid reservoir or tank. Mounting face 166 on the exterior of front housing element 162 would become attached, via an intervening gasket, to a bulkhead wall of the tank, and where the drive shaft portion 167 (formed as part of the rotatable unit) would protrude through the bulkhead in order that it can be driven, for example, by an electric motor. However it should be noted that when required, the addition of an outer housing jacket and well and inlet and exit ports would adapt this embodiment to that form of the present invention as has already been described for the first two embodiments.

As the second difference over the earlier two embodiments, there is the absence of a diaphragm or a piston member to take care of volume changes of the viscous fluid residing in the heat generating chamber. In this example, rear housing member 161 has a bore 169 for bearing 170 which does not breach the outer skin of material of wall 171 in rear housing member 161. Consequently, viscous fluid inside the heat generating chamber is surrounded on all sides by respective internal walls of the rear, front and sleeve 161, 162, 163 members, and when ready to expand or contract in volume due to temperatures changes, can only do so if the heat generating chamber is provided with a sufficiently sized free pocket of air or, preferably inert gas, so that when volume changes in the viscous fluid do occur, the pocket can become smaller or larger as the case may be. The intention is therefore to only partially fill the heat generating chamber with viscous fluid, leaving at most 8% free volume for fluid when it reaches its most likely maximum operating temperature of over 100 deg. C.

If to be operated with air, preferably plug 172 is adapted to act as a air breather and arranged in a suitable way and location in order to avoid or minimize loosing viscous fluid from the heat generating chamber.

Rotor portion 168 of rotatable unit has an entrance port 175 near to wall 171 of rear housing member 161, the entrance port 175 leading to longitudinal passageway 176 and where there are five respective rows of holes 177, 178, 179, 180, 181 opening on the exterior fluid shearing surface 182 of rotatable unit 168. For applications where any such additional heating provided from rows of holes 177, 178, 179, 180, 181, is unnecessary or unwanted, longitudinal passageway 176, acting as the fluid storage vessel, may be connected via suitable radial drillings to the space adjacent respective end faces of the rotor portion 168, in the manner as has already been shown and described in FIG. 5, namely the passages 131, 132 and 133 in FIG. 5. In this case, heating of the viscous fluid would be caused solely by fluid shear.

Regardless of wherein the heat generating surface 182 has holes or note, exterior surface 173 of housing sleeve 163, termed the external heat extracting surface (in this embodiment unlike the earlier two embodiments of the present invention, the external heat extracting surface is not surrounded by a jacket), is where the collected heat is dispatched to the reservoir fluid surrounding the device 160.

When incorporated, each respective row of holes being drilled to communicate with longitudinal passageway 176 by way of smaller-sized holes, 183, 184, 185, 186, 187. When the device 160 is operated, viscous fluid residing in the interior vessel that is longitudinal passageway 176 is at least partially evacuated by the centrifugal action that causes fluid to move radially outwards and through smaller-sized holes, such as holes 183, connecting holes, such as hole 177, to reach the fluid shearing surface where the shearing of the viscous fluid will take place. Once the device is switched off, the viscous fluid reverses back under the influence of gravity into longitudinal passageway 176 which acts as a fluid store. However, what is unique here is that when operating, and provided the correct amount of viscous fluid to meet the typical operating condition expected, longitudinal passageway 176 become a low pressure or vacuum pressure region, and as such, the resulting vacuum condition in and around the openings of the holes 177, 178, 179, 180, 181 cause an additional heating of the viscous fluid by hydrodynamic cavitation.

Figure 8:
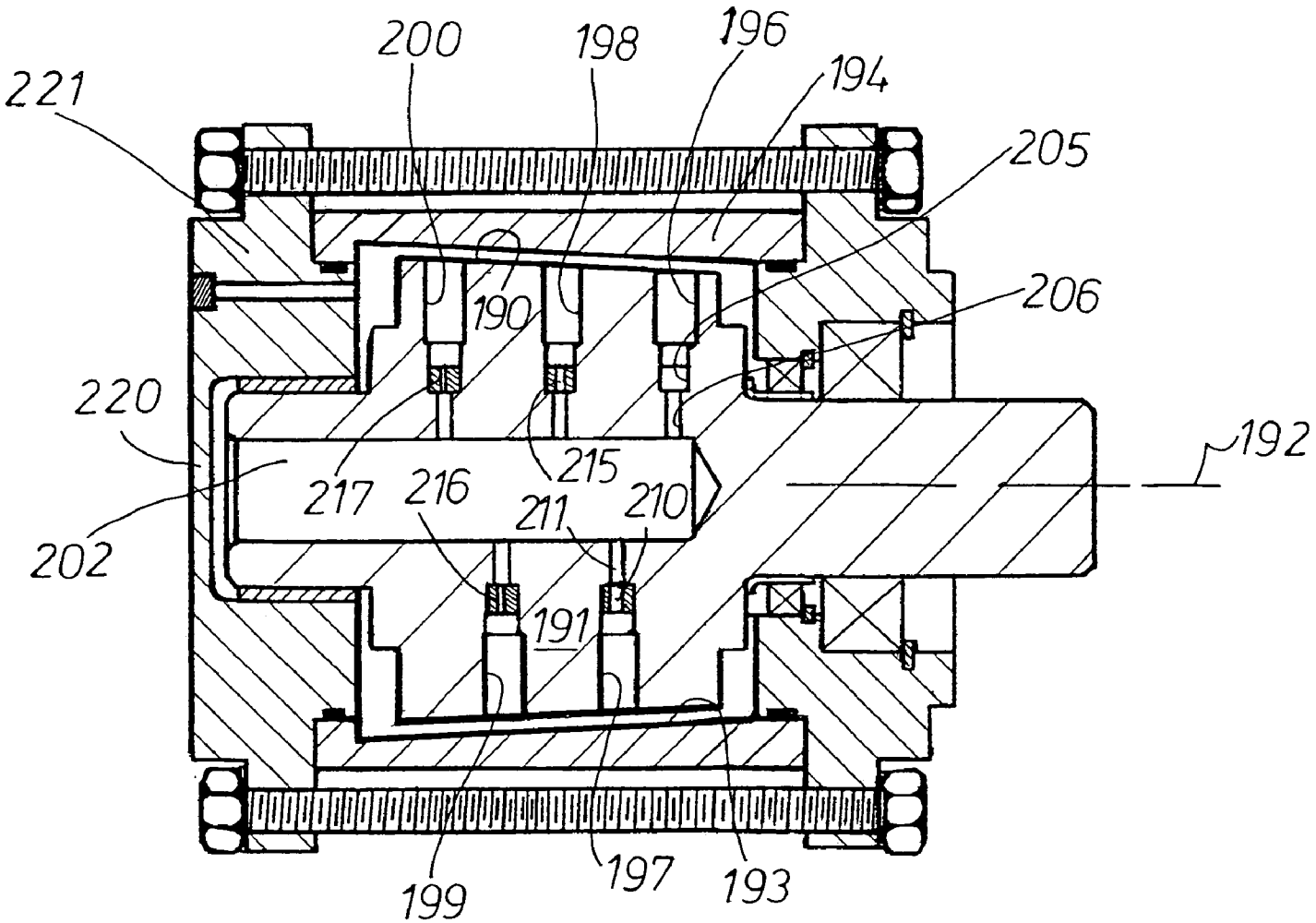
FIG. 8 is the device of FIG. 7 illustrating a modified form of rotor.
Figure 9:
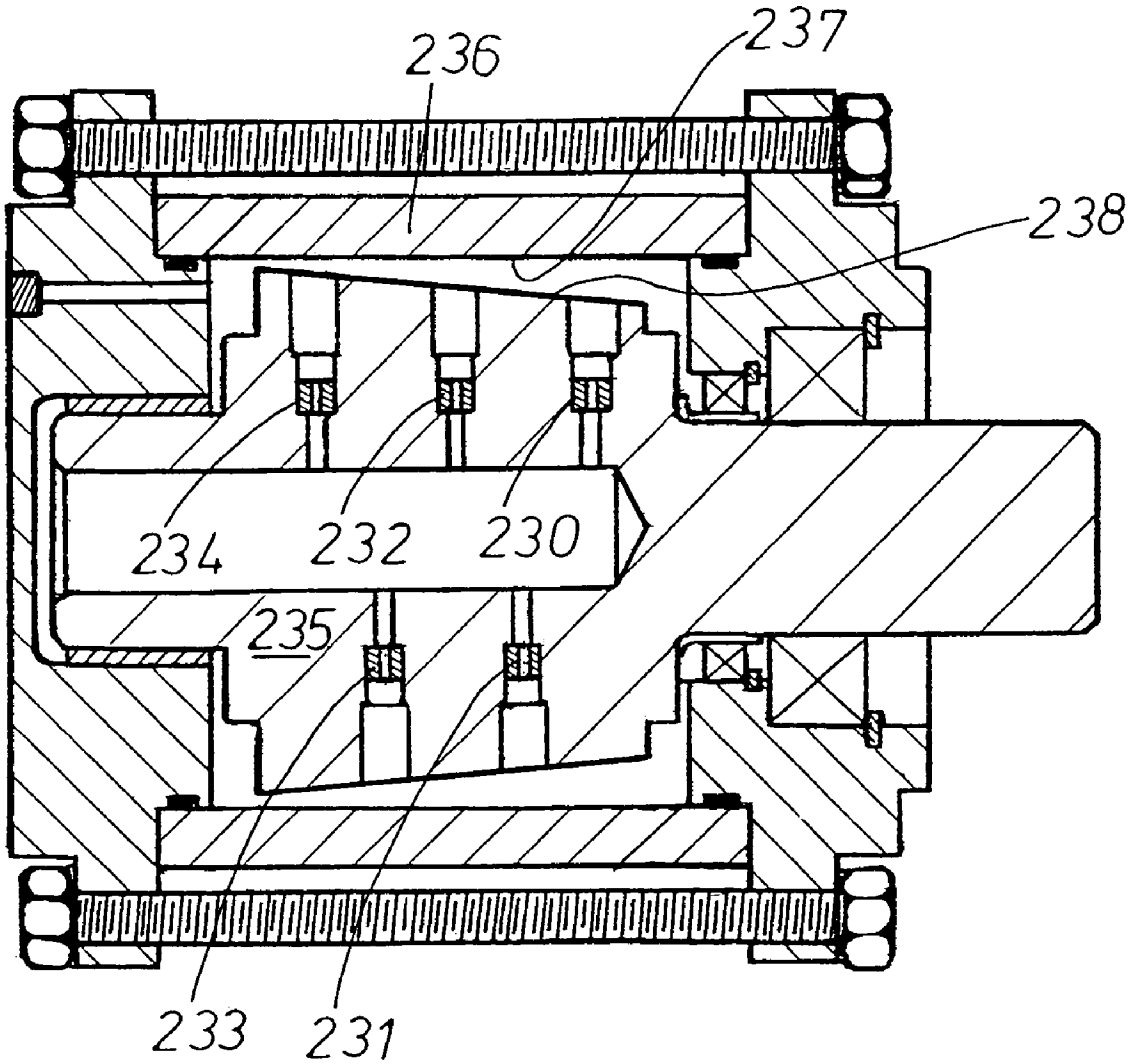
FIG. 9 is the device of FIG. 7 illustrating a further modified form of rotor.

In respect of FIG. 8, this shows a modified rotatable unit where the exterior surface 190 of the rotatable unit, denoted by reference numeral 191, is tapered with respect to longitudinal axis 192, and similarly, bore 193 of sleeve 194 is also tapered with respect to axis 192. In this example, the five respective rows of holes 196, 197, 198, 199, 200, each opening onto the exterior surface 190 are not all unrestricted in their respective flow connections with longitudinal passageway 202. Whereas hole 196 communicates via stepped holes 205, 206 with longitudinal passageway 202, by contrast the next adjacent row of holes 197 communicate via a fluid throttling orifice 210 and hole 211 with longitudinal passageway 202. As shown, the fluid throttling orifices in other rows, namely denoted by reference numerals 215, 216, 217 have an orifice size which decreases in size the nearer the row is to end wall 220 of housing member 221. However, as shown in FIG. 9, the size of the orifices in each of the throttles denoted by reference numerals 230, 231, 232, 233, 234 in rotor 254 may be similar in size. The housing sleeve 236 in FIG. 9 is shown with a parallel bore 237 whereas the outer surface 238 of rotor 235 is part conical in shape.

DETAILED DESCRIPTION OF THE FOURTH ILLUSTRATIVE EMBODIMENT OF THE INVENTION

Figure 10:
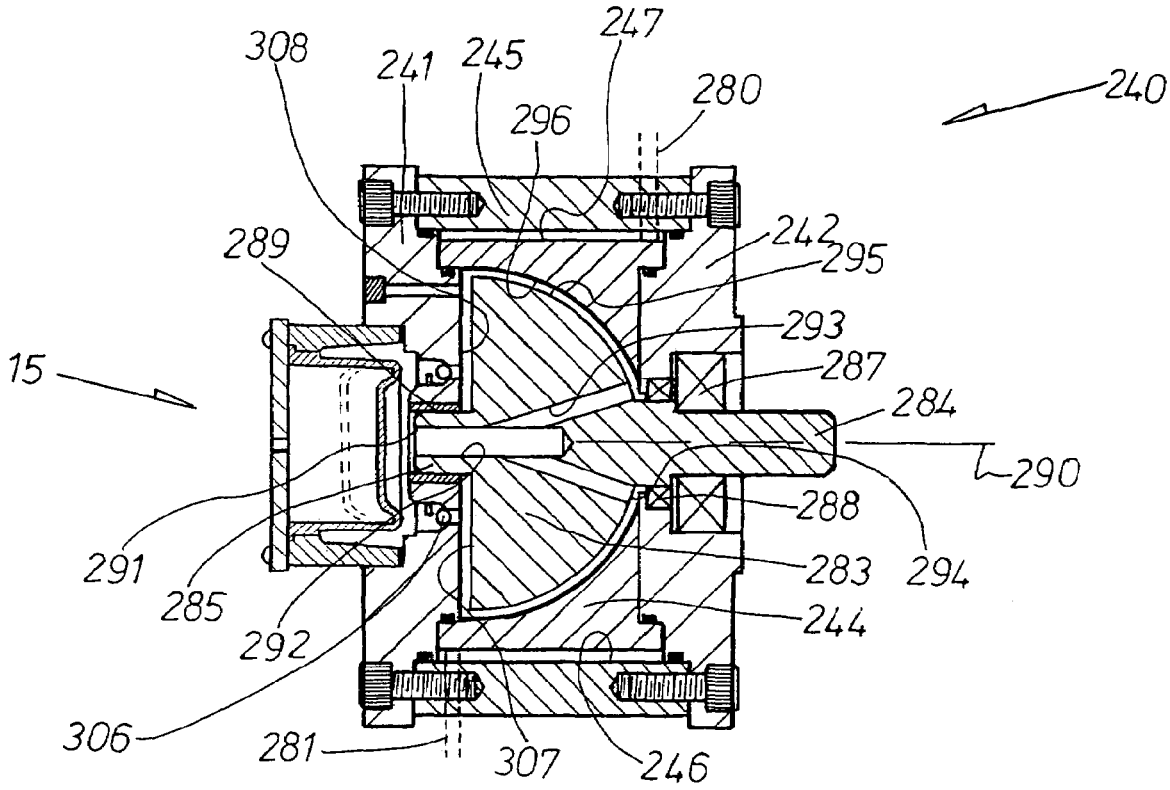
FIG. 10 is a longitudinal sectional view of a device in according to the fourth embodiment of the present invention.

Referring first to FIG. 10, the device 240, the housing structure surrounding the heat generating chamber comprising rear and front members 241, 242 and a middle member 244. A housing jacket 245 surrounds middle member 244 and where the space between bore 246 of jacket 245 and exterior surface 247 of middle member forms the pathway for the heat extracting fluid, here shown able to enter through a port indicated by dotted lines 280 and exiting through a port indicated by dotted lines 281.

The rotor and drive shaft is preferably an integral rotating unit, and hence the rotor portion, protruding shaft portion and inner shaft portion receive the respective reference numerals 283, 284, 285. Front housing member 242 receives a bearing 287 and a seal 288 and which surround protruding shaft portion 284, and rear housing member 241 receives bearing 289 to support inner shaft portion 285.

Rotor portion 283, protruding shaft portion 284 and inner shaft portion 285 are rotatable as a unit on longitudinal axis 290. Alternatively, should the rotor and drive shaft be manufactured as two separate components, the rotor would preferably be provided with a central hole with its center coincident with axis 290, and the drive shaft would extend through this hole to support the rotor and be, for instance, connected together to transmit driving torque to the rotor by means of a spline.

Inner shaft portion 285 is provided with an entrance port 291 leading to longitudinal passageway 292, and the viscous fluid can flow along longitudinal passageway 292 before being directed by one or more angled passageways 293 that open at 294 on the surface exterior 295 of the rotor portion 283.

The interior of middle housing member 244 is provided with a female hemi-spherical surface 296, and where rotor portion 283, having a similarly shaped male hemi-spherical surface 295, is in spaced separation from this surface 295 so that the working clearance between these surfaces 295, 296 forms the gap where the shearing by viscous friction can take place and which results in the heating of the middle housing member 244.

Figure 11:
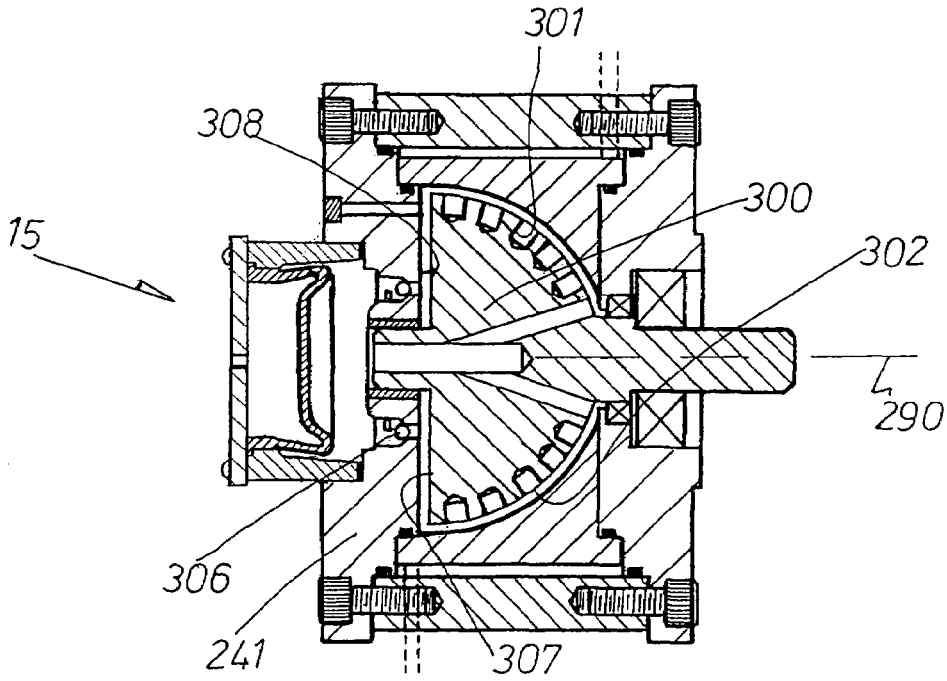
FIG. 11 is the device of FIG. 10 illustrating a modified form of rotor.

As shown, this clearance height is of constant value over the entire distance between surfaces 295, 296, but could alternatively, be arranged to diverge or converge in size in relation to the increasing rotor radial dimension. The centre point chosen by the creator of the device along axis 290 from which the respective hemispherical shapes are generated determines the gap height. FIG. 11 shows the rotor portion 300 having a number of bottom-ended holes 301 disposed over its surface 302 to provide any additional heated by hydrodynamic cavitation of the viscous fluid in this region of the heat generating chamber. Such bottom-ended holes 301 would of course cover 360 degrees of the surface 302 of rotor portion 300.

As for the first embodiment, an identical deformable element indicated by reference numeral 15 is shown operating in association with the heat generating chamber. Best seen in FIG. 10, one or more non-return valves 306 may be disposed in rear housing member 241 and positioned to allow the circulation of viscous fluid, arriving in the space between rotor end face 307 and adjacent confronting wall 308, to return towards axis 290 before being drawn into entrance port 291, longitudinal and angled passageways 292, 293 to be re-admitted to the fluid shearing gap between respective hemispherical surfaces 295, 296. The hemispherical shapes promote a tendency in the viscous fluid to flow in a radially outwardly direction before returning to entrance port 291 via "open" non-return valves 306.

DETAILED DESCRIPTION OF THE FIFTH ILLUSTRATIVE EMVODIMENT OF THE INVENTION

Figure 12:
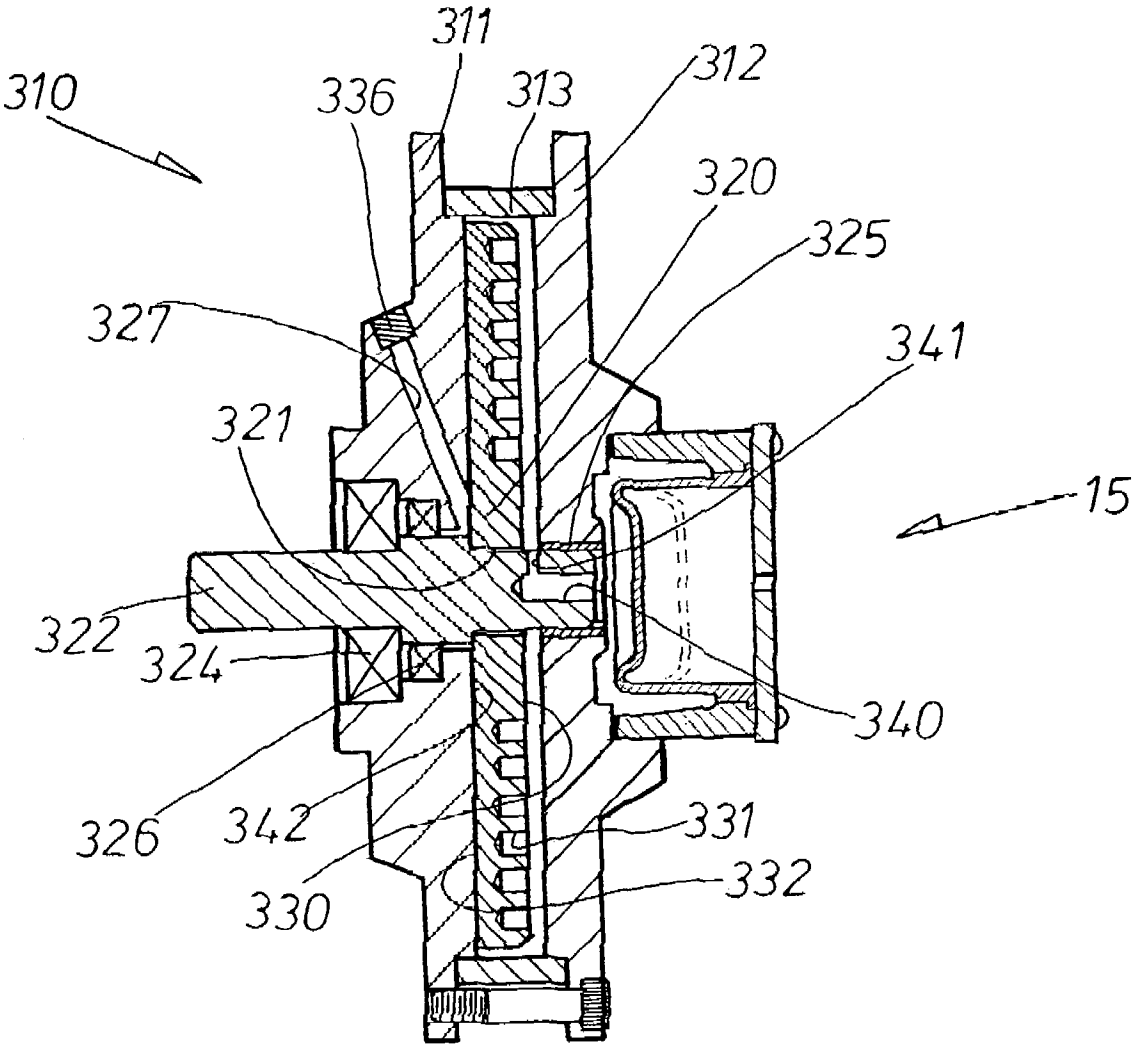
FIG. 12 is a longitudinal sectional view of a device in according to the fifth embodiment of the present invention.

Referring to FIG. 12, the device 310 has a housing structure comprising three members 311, 312, 313 forming the heat generating chamber. In the heat generating chamber lies a circular disc rotor 320, the rotor 320 being splined or screw threaded onto drive shaft 322. If the rotor 320 is screwed to the drive shaft 322 by a screw thread, the direction of the thread should preferably be counter to the direction of rotation of the drive shaft so that the rotor does not come apart on the commencement of drive shaft rotation. Drive shaft 322 is supported by a pair of bearings 324, 325 located in respective housing members 311, 312, and where seal 326 and deformable element 15 are disposed in respective housing members 311, 312. Deformable element 15, being indicated by the same reference numeral as was used in both the first and fourth embodiments of the present invention, is identical to deformable element as already described in detail for the first embodiment.

Also similarly to the third embodiment already described in detail above, this fifth embodiment of the present invention also relies on the device 310 being submerged in a tank or reservoir of heat extracting fluid in order for the generated heat to be extracted from the device 310. It should however be noted, this embodiment, like the third, can be adapted by adding a housing jacket.

With a housing jacket surrounding housing element 313, the pathway formed would enable a further fluid medium, the heat extracting fluid, to pass through and extract heat which is generated by the drive shaft 322 driven rotor 320 rotates at high speed in viscous fluid in the heat generating chamber. As shown, only circular face 330 of the rotor 320 is disposed with a plurality of bottom-ended holes 331 covering 360 degrees over the rotor surface 330. However, it should be noted that the opposing face 332 could also have a plurality of such bottom-ended holes, but depending on the thickness of the disc rotor 320, such additions may be offset from holes on the opposite space unless it is desired that the holes be linked together in the interior of the rotor disc. Furthermore, the disc rotor 320 may for certain applications be formed with relatively smooth surface faces 330, 332 devoid of any such bottom-ended holes. Plug 336 is a filling plug for the viscous fluid, and closes drilled passage 327 connecting heat generating chamber. Longitudinal and radial passageways 340, 341 are disposed in drive shaft 322 in order to allow volumetric movement of viscous fluid in the heat generating chamber to take place in association with deforming movement of the deformable device 15. When the opposite face of the rotor 332 receives its share of holes, longitudinal passageway 340 would be extended and a further radial passageway included in order for viscous fluid to reach that side of the disc. Furthermore, the clearance between the end face 332 and interior housing wall 342 would be increased.

In general, the term viscous fluid as used in this specification refers to any type of fluid medium that generates heat based on fluid friction when sheared by a high-speed rotor. The fluid typically used in such generators is silicone oil but the term as used is not meant to be limited to fluids having a relatively high viscosity, much less to silicone oil.

In accordance with the patent statutes, I have described the principles of construction and operation of my invention, and while I have endeavoured to set forth the best embodiments thereof, I desire to have it understood that obvious changes may be made within the scope of the following claims without departing from the spirit of my invention.

The invention claimed is:

1. An apparatus for the heating of two dissimilar fluids comprising:

a housing having an internal heat generating chamber and an external heat extracting surface, wherein one of said two dissimilar fluids is a viscous fluid disposed in said heat generating chamber, the other of said two dissimilar fluids is the heat extracting fluid for direct contact with said heat extracting surface; and further comprising a rotatable unit disposed centrally in said heat generating chamber and mounted for rotation within said heat generating chamber about an axis of rotation and a displaceable element in fluid communication with said heat generating chamber, wherein said rotatable unit further comprises a fluid shearing surface formed on a face thereof, a series of holes disposed in the interior of said rotatable unit, at least one internally disposed fluid passageway disposed in said rotatable unit, said rotatable unit further comprising an entrance port formed on a further face thereof and said fluid passageway fluidly connecting with said series of holes to supply said viscous fluids to said fluid shearing surface, and further comprising at least one fluid throttling orifice disposed in at least one of said series of holes.

2. The apparatus according to claim 1, wherein said displaceable element lies axially adjacent said entrance port, and said displaceable element assimilating any volume change in the fluid capacity of said heat generating chamber.

3. The apparatus according to claim 1, further comprising at least one fluid throttling orifice disposed in said at least one of said fluid passageways.

* * * * *